United States Patent [19]

Sheppard et al.

[11] Patent Number: 4,760,735

[45] Date of Patent: Aug. 2, 1988

[54] METHOD AND APPARATUS FOR INVESTIGATING DRAG AND TORQUE LOSS IN THE DRILLING PROCESS

[75] Inventors: Michael C. Sheppard, Shudy Camps, England; Christian Wick, Bergen, Norway

[73] Assignee: Anadrill, Inc., Sugar Land, Tex.

[21] Appl. No.: 916,268

[22] Filed: Oct. 7, 1986

[51] Int. Cl.[4] ..... E21B 47/00

[52] U.S. Cl. ..... 73/151; 364/422

[58] Field of Search ..... 73/151, 151.5; 364/422

[56] References Cited

U.S. PATENT DOCUMENTS

| | | | |
|---|---|---|---|
| 4,064,749 | 12/1977 | Pittman et al. . | |
| 4,384,483 | 5/1983 | Dellinger et al. . | |
| 4,549,431 | 10/1985 | Soeiinah | 73/151 |
| 4,597,289 | 7/1986 | Obrecht | 73/151 |

OTHER PUBLICATIONS

T. M. Warren, "Factors Affecting Torque for a Roller Cone Bit" Journal of Petroleum Technology, Sep. 1984.

C. A. Johnancsik, D. B. Friesen, and R. Dawson, "Torque and Drag in Directional Wells–Prediction and Measurement," IADC/SPE 11380, Feb. 20–23, 1983.

*Primary Examiner*—Jerry W. Myracle

*Attorney, Agent, or Firm*—Stephen L. Borst

[57] ABSTRACT

Drilling conditions are analyzed by, for example, measuring the torque applied at the surface to the drill string and the effective torque acting on the drill bit. The applied torque and effective torque are compared to determine torque loss. Likewise, applied weight on the drill string and effective weight acting on the drill bit may be measured and compared to determine drag losses. These measurements and comparisons may be done in real-time to diagnose unfavorable drilling conditions. The torque or weight measurements may be used to calculate a variable coefficient of friction acting on the drilling string. Trends in the torque or weight losses, or in the value of the coefficient of friction, may be observed on a plot of these quantities as a function of depth.

15 Claims, 5 Drawing Sheets

FIG. 3
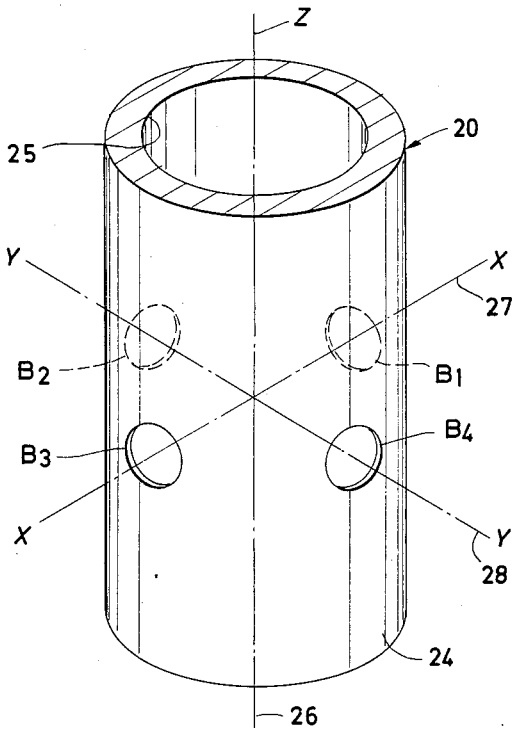
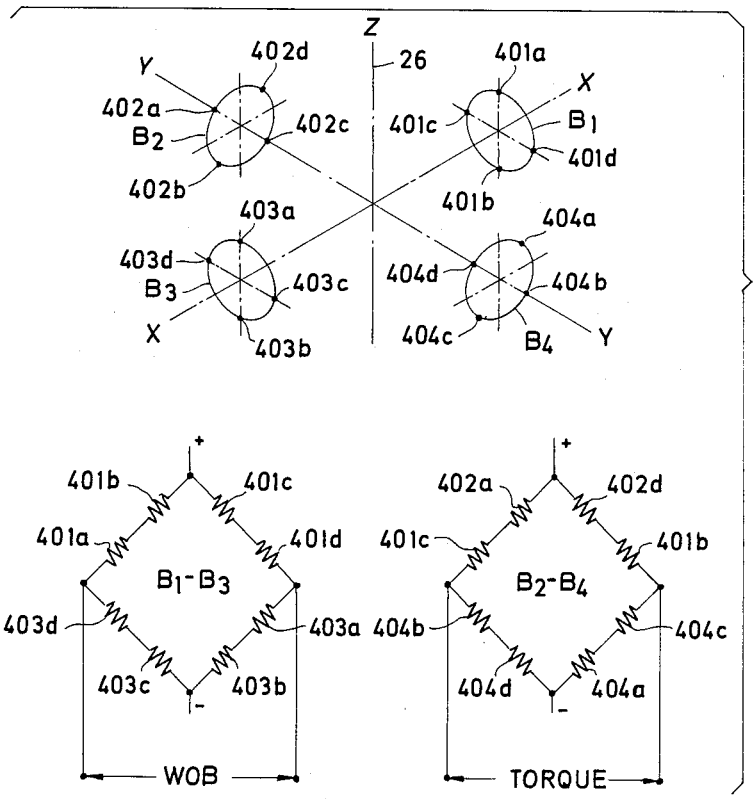
FIG. 4

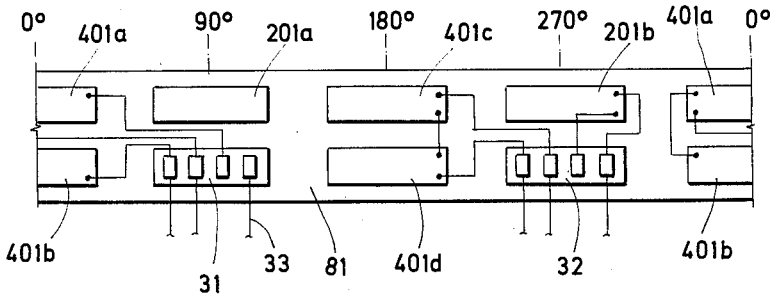
FIG. 5
FIG. 8
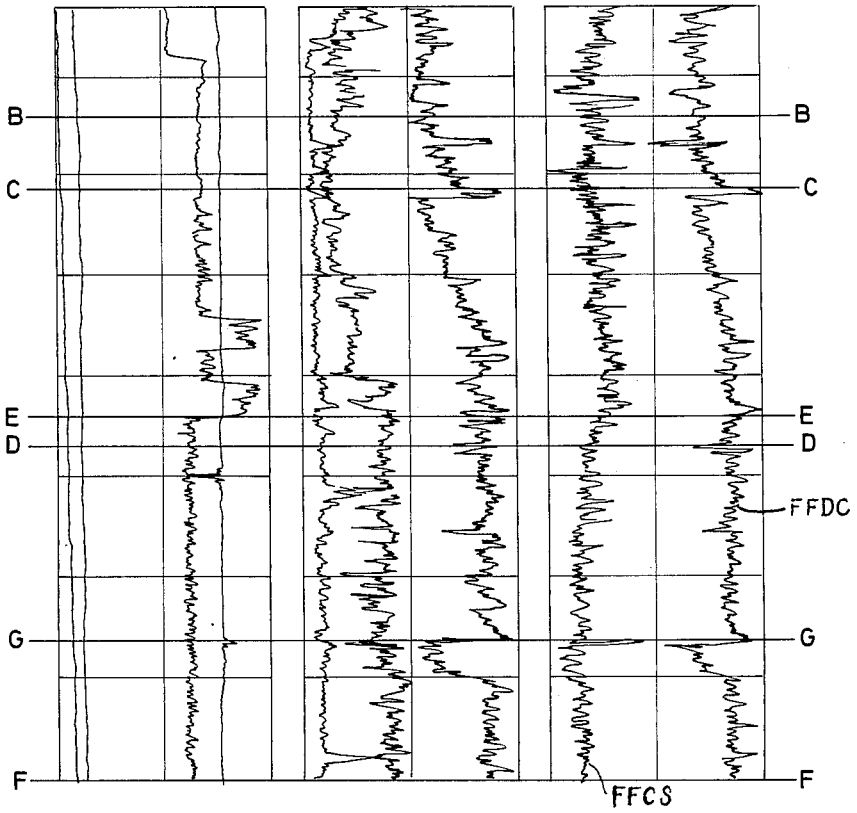

METHOD AND APPARATUS FOR INVESTIGATING DRAG AND TORQUE LOSS IN THE DRILLING PROCESS

BACKGROUND OF THE INVENTION

This invention relates to the field of measurements while drilling, and more specifically to planning and analysis of the drilling process.

Drag and torque loss affect the drilling of all hydrocarbon wells, and are especially problematic in deviated wells. Drag manifests itself as an extra load over and above the rotating string weight when tripping out of the hole. Torsional loss from the rotating drill string while drilling causes the power available for rock destruction to be considerably lower than that applied at the rotary table. Problems of drag and torque loss normally occur together and can be particularly marked in long reach wells.

There are a variety of sources of drag and torque loss including differential sticking, keyseating, hole instabilities, poor hole cleaning, and the frictional interaction associated with side forces along the drill string. The side forces profile is essentially determined by well geometry, and can be broadly divided into the effects of poor hole conditions or inappropriate mud weight, and effects of the well path itself.

U.S. Pat. No. 4,549,432 to Soeiinah (assigned to Mobil Oil Corporation) discloses a method of detecting some of these problems in the drilling of a well from uphole measurements of hook load and free rotating torque. But experience has shown that noticeable differences occur between the torque and weight applied at the surface and that effectively applied at the bit, especially in areas of potential drilling problems. Likewise, the hookload values and the weight of the drill string in mud usually differ. Thus, the technique of the Soeiinah patent has serious inherent limitations.

The 1983 paper, "Torque and Drag in Directional Wells—Prediction and Measurement," by C. A. Johancsik, D. B. Friesen, and Rapier Dawson (IADC/SPE 1983 Drilling Conference, Paper No. 11380), proposed a computer model of drill string torque and drag, but like the Soeiinah method, this model suffers from failure to analyze downhole torque and weight parameters.

Because the available techniques lack a way of investigating and analyzing downhole torque and weight on bit, which may differ significantly from the corresponding surface measurements of torque and hookload, there remains a gap between planned optimization of a drilling program and its implementation. Thus, a need has arisen for a new technique by which torque and weight transfer along the drill string can be analyzed, both in real-time for diagnosis of drilling problems and in advance for planning.

SUMMARY OF THE INVENTION

In a preferred embodiment of the invention, the conditions under which an earth boring apparatus such as a conventional drill bit operates are analyzed by measuring the torque applied at the surface to the drill string and the effective torque acting on the drill bit. The applied torque and effective torque are compared to determine torque loss. Likewise, applied weight on the drill string and effective weight acting on the drill bit may be measured and compared to determine drag losses. These measurements and comparisons may be done in real-time to diagnose unfavorable drilling conditions, or to assist the driller in decisions such as whether to trip out to change a bottom hole assembly, or to attempt a hole cleaning process such as a wiper trip, or to perform other procedures. The torque or weight measurements may be used to calculate a variable coefficient of friction acting on the drilling string. Trends in the torque or weight losses, or in the value of the coefficient of friction, may be observed on a plot of these quantities as a function of depth.

In addition to this real-time analysis, it is a further embodiment of the invention to plan or predict what is to be expected in a drilling process by assuming predetermined values for the coefficient of friction for the hole as a function of depth and calculating therefrom the torque and drag losses which are to be expected.

The present invention thus provides a method for analyzing torque and weight transfer along a drill string, to give the driller an enhanced insight into drilling efficiency and problem situations in the drilling process. In a preferred embodiment of the invention, the real-time analysis may be performed with the bit on bottom by detecting and interpreting trends of abnormal torque transfers. Abnormal weight transfers are analyzed based on hookload and weight transfer analysis. These techniques can be used alone or in combination to diagnose and quantify drilling problems related to drag and torque loss.

As a planning tool, the techniques of the present invention produce expected trends for weight and torque transfers in a given environment including the well profile, the bottom hole assembly design, the lithological sequence and the mud program. Weight and torque losses for several such drilling plans may be calculated, so that the most favorable plan may be chosen.

BRIEF DESCRIPTION OF THE DRAWINGS

FIG. 3 is an isometric view of a preferred embodiment of a force measuring means in the FIG. 1 embodiment;

FIG. 4 is a schematic representation of the force measuring means shown in FIG. 3 showing preferred locations for various sets of force sensors and bridge circuit associated with these sensors;

FIG. 5 is an enlarged view of one portion of the force measuring means of FIG. 2 illustrating a preferred mounting arrangement for the force sensors;

FIG. 8 shows a log correlating weight and torque loss to drilling practices, lithology and bottomhole assembly.

DETAILED DESCRIPTION OF A PREFERRED EMBODIMENT

Figure 1:
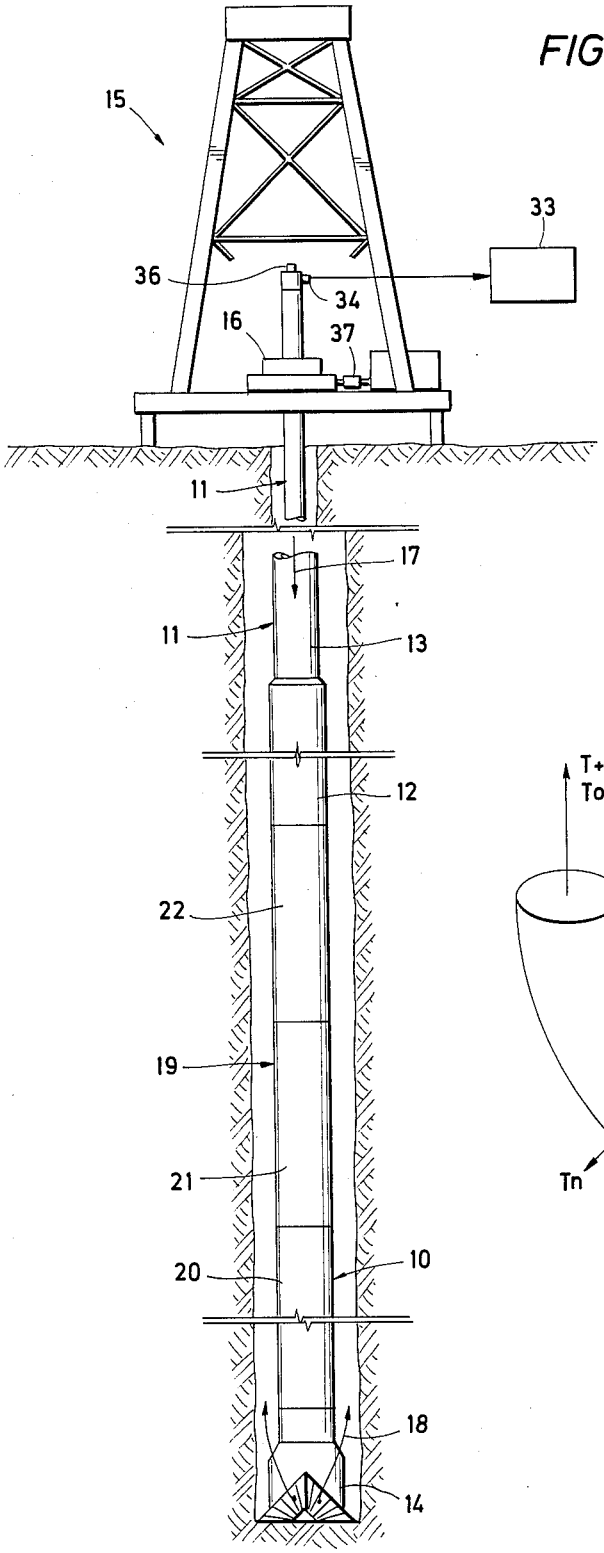
FIG. 1 shows a preferred embodiment of an apparatus according to the present invention as it may appear while practicing the method of a preferred embodiment of the invention while drilling.

Turning now to FIG. 1, an apparatus suitable for performing a method according to a preferred embodiment of the invention includes a measurement-while-drilling (MWD) tool 10 dependently coupled to the end of a drill string 11 comprised of one or more drill collars 12 and a plurality of tandemly connected joints 13 of drill pipe. Earth boring means, such as a conventional drill bit 14, are positioned below the MWD tool. The drill string 11 is rotated by a rotary table 16 on a conventional drilling rig 15 at the surface. Mud is circulated through the drill string 11 and bit 14 in the direction of the arrows 17 and 18.

As depicted in FIG. 1, the tool 10 further comprises a plurality of heavy walled tubular bodies which are tandemly coupled to enclose weight and torque measuring means 20 adapted for measuring the torque and weight acting on the drill bit 14, as well as typical position measuring means 21 adapted for measuring parameters such as the direction and inclination of the tool 10 so as to indicate its spatial position. Typical data signaling means 22 are adapted for transmitting encoded acoustic signals representative of the output of the sensors 20 and 21 to the surface through the downwardly flowing mud stream in the drill string 11. These acoustic signals are converted to electrical signals by a transducer 34 at the surface. The electrical signals will be analyzed by appropriate data processing means 33 at the surface.

Conventional sensors for measuring hookload and torque applied to the drill string, 36 and 37 respectively, are located at the surface. A total depth sensor (not shown) is provided to allow for the correlation of measurements made during the drilling and tripping modes.

Turning now to FIG. 3, the external body 24 of the force-measuring means 20 of a preferred embodiment is depicted somewhat schematically to illustrate the spatial relationships of the measurement axes of the body as the force-measuring means 20 measure weight and torque acting on the drill bit 14 during a typical drilling operation. Rather than making the force-measuring means 20 an integral portion of the MWD tool 10, in a preferred embodiment, the thick-walled tubular body 24 is cooperatively arranged as a separate sub that can be mounted just above the drill bit 14 for obtaining more accurate measurements of the various forces acting on the bit. It will, of course, be appreciated that other types of housings such as, for example, those shown in U.S. Pat. Nos. 3,855,857 or 4,359,898 could be used as depicted there or with modifications as needed for devising alternative embodiments of force-measuring apparatus suitable for use in the apparatus and method of the present invention.

As seen in FIG. 3, the body 24 has a longitudinal or axial bore 25 of an appropriate diameter for carrying the stream of drilling mud flowing through the drill string 11. The body 24 is provided with a set of radial openings, B1, B2, B3 and B4, having their axes all lying in a transverse plane that intersects the longitudinal Z-axis 26 of the body. It will, of course, be recognized that in the depicted arrangement of the body 24 of the force-measuring means 20, these openings are cooperatively positioned so that they are respectively aligned with one another in the transverse plane that perpendicularly intersects the Z-axis 26 of the body. For example, as illustrated, one pair of the holes B1 and B3, are respectively located on opposite sides of the body 24 and axially aligned with each other so that their respective central axes lie in the transverse plane and together define an X-axis 27 that is perpendicular to the Z-axis 26 of the body. In like fashion, the other two openings B2 and B4 are located in diametrically-opposite sides of the body 24 and are angularly offset by 90 degrees from the first set of openings B1 and B3 so that their aligned central axes respectively define the Y-axis 28 perpendicular to the Z-axis 26 as well as the X-axis 27.

Turning now to FIG. 4, an isometric view is shown of the openings B1–B4, the X-axis 27, the Y-axis 28 and the Z-axis 26. As depicted, to measure the longitudinal force acting downwardly on the body member 24 in order to determine the effective weight-on-bit, force-sensing means are mounted in each quadrant of the openings B1 and B2. To achieve maximum sensitivity, these force-sensing means (such as typical strain gauges **401*a*–401*d* and 403*a*–403*d*) are respectively mounted at the 0-degrees, 90-degrees, 180-degrees and 270-degrees positions within the openings B1 and B3. In a like fashion, to measure the rotational torque imposed on the body member 24, rotational force-sensing means, such as typical strain gauges 402*a*–402*d* and 404*a*–404*d*, are mounted in each quadrant of the openings B2 and B4. As depicted, it has been found that maximum sensitivity is provided by mounting the strain gauges 402*a*–402*d* at the 45-degrees, 135-degrees, 223-degrees and 315-degrees positions in the opening B2 and by mounting the other strain gauges 404*a*–404*d* at the same angular positions in the opening B4. Measurement of the weight-on-bit is, therefore, obtained by arranging the several strain gauges 401*a*–401*d* and 403*a*–403*d* in a typical Wheatstone bridge B1–B3 to provide corresponding output signals (i.e., WOB). In a like manner, the torque measurements are obtained by connecting the several gauges 402*a*–402*d* and 404*a*–404*d* into another bridge B2–B4 that produces corresponding output signals (i.e., torque). Those skilled in the art will, of course, appreciate that the several sensors described by reference to FIG. 3 along with other force measuring sensors as desired for other purposes, can be mounted in various arrangements on the body 24. However, it has been found most advantageous to mount the several force sensors in the openings B1–B4 in such a manner that although the force sensors in a given opening are separated from one another, each sensor is located in an optimum position for providing the best possible response. For example, as depicted in the developed view of the opening B1 seen in FIG. 5, the force sensors 401*a* and 401*b* are each mounted at their respective optimum locations in the same openings as are the torque sensors 402*a*–402*d*. It will, of course, be recognized that the several sensors located in the opening B1 are each secured to the body 24 in a typical manner such as with a suitable adhesive. Other sensors 201*a* and 201*b* for example, may also be so mounted. As illustrated, in the preferred arrangement of the force-measuring means 20 it has also been found advantageous to mount one or more terminal strips 31 and 32 in each of the several openings to facilitate the interconnection of the force sensors in any given opening to one another as well as to provide a convenient terminal that will facilitate connecting the sensors to various conductors 33 leading to the measuring circuitry in the MWD tool 10 (not seen in FIG. 5**).

Figure 2:
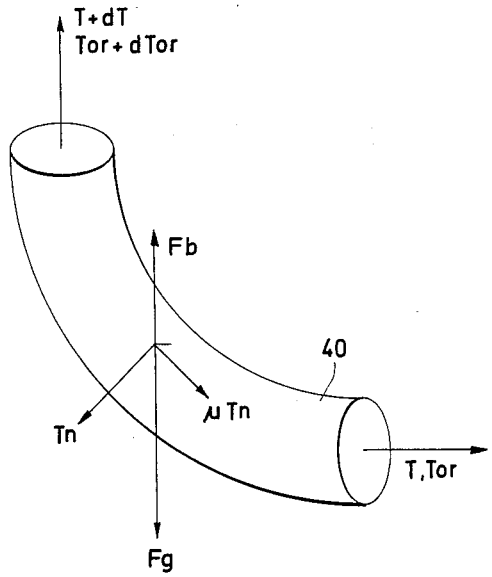
FIG. 2 shows a schematic diagram of a torque and tension model as used in the preferred embodiment of the invention.

As is typical, it is preferred that the several force sensors be protected from the borehole fluids and the extreme pressures and temperatures normally encountered in boreholes by sealing the sensors within their respective openings B1–B4 by means of typical fluid-tight closure members (not shown in the drawings). The enclosed spaces defined in these openings and their associated interconnecting wire passages are usually filled with a suitable oil that is maintained at an elevated pressure by means such as a piston or other typical pressure-comprising member that is responsive to borehole conditions. Standard feed-through connectors (not shown in the drawings) are arranged as needed for interconnecting the conductors in these sealed spaces with their corresponding conductors outside of the oil-filled spaces. Turning now the principles of operation of the present invention, in a preferred embodiment, torque and weight transfer are analyzed using a dynamic torque and tension model diagrammed in FIG. 2. In this model, a tension T and torque TOR act on the downhole end of an incremental length of drill string 40, while an uphole tension T+dT and torque TOR+d(TOR) act on the uphole end. A buoyancy force Fb acts in an upward vertical direction while a gravitational force Fg acts in an opposing direction. These forces all contribute to a resultant side force Tn acting in a direction perpendicular to a plane tangent to the incremental drill string length 40.

The side force Tn given by the equation $$Tn=[(T\,d\theta\text{-}W\sin\theta)^2+(T\,d\phi\sin\theta)^2]^{\frac{1}{2}} \quad (1)$$

where $d\theta$=inclination change, $d\phi$=azimuth change, and W=buoyant weight of the drill string (Fg−Fb). This equation can be solved by iterative methods well-known in the art.

An additional side force component due to stiffness of the drill string can be computed using the theory of bending and twisting of elastic rods. Models using such theories are known to those having ordinary skill in the art, and are contained in the literature associated with this field. One such model is discussed in Jogi et al, "Three Dimensional Bottomhole Assembly Model Improves Directional Drilling," SPE Paper No. 14768, February, 1986. This component may, if desired, be added to Tn in equation (1) to correct for stiffness of the drill string.

A drag force acts along the length of the drill string increment 40, and is assumed to be proportional to the side force Tn acting on the drill string. The proportionality coefficient $\mu(s)$ (which is not necessarily constant but may be a function of the distance s from the bit) appears in this model as a sliding friction coefficient. The resulting frictional force u(s)Tn acts against the motion of the drill string increment 40, leading to drag while tripping out and torque loss while rotating.

The friction profile $\mu(s)$ can be calculated on an incremental basis as follows:

Consider that the well has been drilled to some pipe depth D and that the friction $\mu_d(s)$ down to this point is known (having been calculated in previous increments). The well is now drilled to a pipe depth D+1 and the friction coefficient $\mu_l$ for this last segment is to be calculated (we must assume the $\mu_l$ is a constant over this last segment). The effective tension while rotating, at some height s above the bit is given by $$T(s) = -DWOB + \int_{\text{bit}}^{s} W(s)\cos\theta(s)ds \quad (2)$$

where DWOB is the downhole weight on bit, $W(\bar{s})$ is the buoyed weight per unit length of the tubulars and $\theta(\bar{s})$ is the inclination at $\bar{s}$ obtained from survey data ($\bar{s}$ is an integration variable ranging from zero to $\bar{s}$).

The side force at $\bar{s}$, which is Tn(s), can now be calculated from equation (1) using equation (2) in conjunction with the survey data The torque lost between surface and the bit is given by $$\begin{aligned} STOR - DTOR &= \int_{\text{bit}}^{\text{surface}} \mu(s)Tn(s)R(s)ds \\ &= \int_{\text{bit}}^{D} \mu_l Tn(s)R(s)ds + \int_{D}^{\text{surface}} \mu_D(s)Tn(s)R(s)ds \end{aligned} \quad (3)$$

where s=height above the bit

R(s)=active radius of tubulars

STOR=surface torque

DTOR=effective bit torque and where $\mu_d(s)$ is known. Equation (3) thus provides a means of calculating $\mu_l$ so that the friction profile is now known (at least piecewise) to the new depth D+1. This updated profile is then incorporated in the next increment when the well has reached a pipe depth D+2l.

It should be noted that a significant contrast will be expected between friction coefficients for open and cased hole. In particular it will be necessary to recalculate $\mu(s)$ when casing is set. This can be done by assuming that the new length of casing is characterized by a fixed coefficient $\mu$ which is calculated, as described above, when drilling commences after the casing is set.

Once $\mu(s)$ is determined the overpull when tripping can be calculated. (This will be of substantial value for estimating the overpull for planned wells and may be used to aid in the design of well trajectories). While tripping out of hole the incremental change in effective tension $\Delta T$ for a pipe increment of length $\Delta s$ is given by $$\Delta T=\Delta s\ W(s)\cos\theta(s)+\mu(s)Tn(s) \quad (4)$$

Given $\mu(s)$ then equations (1) and (4) provide the elements of an incremental (generally numerical) solution for the effective tension T(s). The evaluation of T(s) at the surface gives the hook load, and the overpull is the difference between the hook load and the free rotating weight of the drill string.

As distinct from the proposals of Johancsik et al who, in the above-referenced paper, define a global coefficient of friction, a preferred embodiment of the invention described here proposes a running calculation of the friction profile $\mu(s)$. This has the effect of generating a far more sensitive characterization of the frictional effects than is provided by the global friction approach which effectively smears local effects over the entire drill string.

This quantity $\mu$ yields useful information about how drilling is progressing. For example, if the bottom hole assembly remains unchanged, then an increase in the coefficient of friction indicates a change in hole condition, hole shape of lithology, or a malfunction of the bottom hole assembly. The quantity $\mu$ is preferrably calculated and recorded as a function of depth while drilling (or tripping) progresses, to produce a log useful in the diagnosing of drilling or well bore problems.

Values for HKLD and DWOB, as well as STOR and DTOR, can be compared at successive depths to determine torque and weight losses. Such losses, as is the quantity $\mu$, are preferably correlated with depth and recorded as a function of depth on a log. Trends and changes can then be observed.

Figure 7:
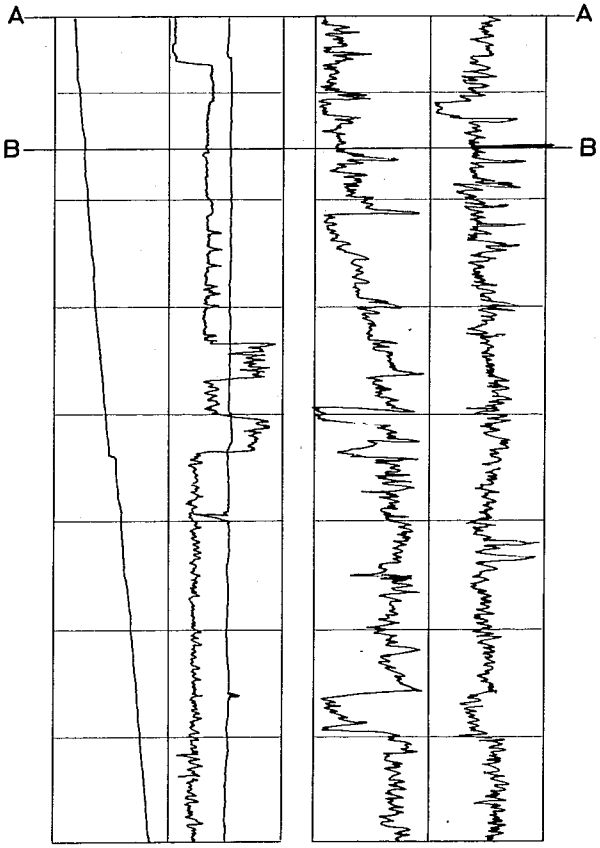
FIG. 7 shows a log of weight and torque losses.
Figure 6:
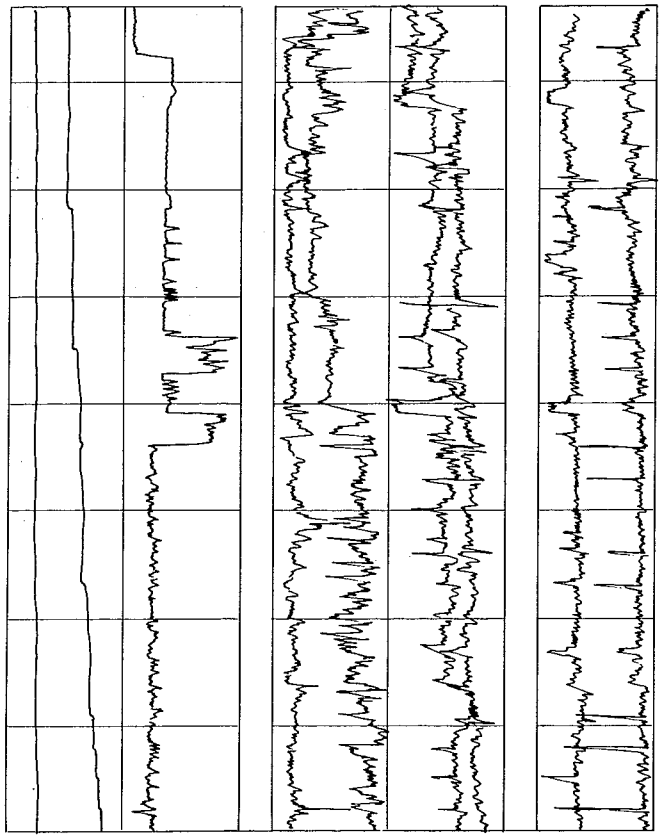
FIG. 6 shows a log of data obtained in a well with an apparatus and method according to a preferred embodiment of the invention.

FIGS. 6, 7 and 8 show an illustrative example of how a method according to a preferred embodiment of the invention may be used. These figures show logs obtained according to a preferred embodiment of the present invention in a relatively straight well having a constant inclination.

from the left The following data is shown on the DATA log of FIG. 6:

Track 1: mud weight in (MWTI), and total hook load (THKD),

Track 2: flow rate (RPM) in rotations per minute;

Track 3: gamma ray (GR) and rate of penetration averaged over five foot intervals (ROPS);

Track 4: downhole weight on bit (DWOB); surface weight on bit (SWOB);

Track 5: downhole torque (DTOR); surface torque (STOR).

FIG. 7 shows a log of weight and torque losses, computed from inputs taken from the DATA log of FIG. 6. from the left. Track 1 of the WEIGHT AND TORQUE LOSSES log shows the calculated free rotating hookload (THDC). Track 3 shows shows the weight-on-bit losses between surface and downhole (WODC). The best weight transfer is achieved in the section from A-A to B-B when WODC is minimal. The torque transfer (TODM), the difference between the measured surface torque and the measured downole torque, is shown in Track 3.

Referring now to FIG. 8, the ANALYSIS log was produced in order to investigate explanations for weight-on-bit and torque transfer problems related to hole stability and crookedness. Correlations were sought between weight-on-bit and torque transfer and drilling practices (especially off bottom periods between the drilling sequences), lithology, and bottomhole assembly configuration.

The following variables already defined in the previous logs are shown in FIG. 8:

Track 1: total hookload and free rotating string weight;

Track 2: rpm and flow rate;

Track 3: gamma ray and rop; and

Track 4: weight-on-bit loss

The calculated variables shown in this log are:

Track 5: friction factor (FFCS) calculated with the torque losses from bit to surface;

Track 6: friction factor correction (FFDC) calculated with the WOB losses (WODB) from bit to surface.

The ANALYSIS log in FIG. 8 clearly shows the effectiveness of the reaming when the joint is drilled out in the WODC track, which shows an improved weight transfer when the drilling is resumed at C—C. This log also shows that the weight-on-bit transfer is better in the less argileaous sections up to C—C. The transfer decreases when the clay content increases between C—C and D—D. A circulation exceeding 20 minutes was done at C—C is shown to drastically increase the transfer. Off bottom time at C—C exceeded 50 minutes, for a wiper trip. The C—C level is also the level where the last stabilizer reached a cleaner limestone section starting at B—B. Trends can be seen on the log which reflect the overall interaction between the borehole walls and the drillstring.

The ANALYSIS log shows the friction factor correction FFDC due to weight-on-bit loss to be, in effect a normalization of the weight-on-bit transfer WODC, since the FFDC track follows the trends of the weight-on-bit transfer track.

Between E—E and F—F, there is a constant decrease of the weight-on-bit transfer while a single joint is drilled. Two thousand pounds are regularly lost between the beginning and the end of the kelly length drilled out.

At G—G, a complete WOB transfer was obtained. This corresponds to a connection with a 10-minute circulation. The 15-minute reaming operation was particularly efficient due to an increased flow rate used at this point. The beneficial effect is also noted in the friction factor decrease. It shows also that the benefit of this procedure lasted only for 45 feet. This kind of information will be useful to a driller in deciding whether to perform such procedures.

Turning now to another embodiment of this invention, Equations (2) and (3) can be used for well planning by assuming a constant value for u over a portion of a well and calculating the torsional and drag losses which should be expected for a given trajectory. The assumed value for u may be chosen from knowledge of wells in similar lithologies, as in the case of multiple wells drilled from a single platform. Alternatively, a value of 0.3 as an estimate of u has been found to work satisfactorily for comparison purposes where torque and drag losses for several trajectories are computed and compared to determine the optimal trajectory. It would also be possible to assume a particular functional form for $\mu(s)$ and an initial value to arrive at torque and drag loss.

Figure 9:
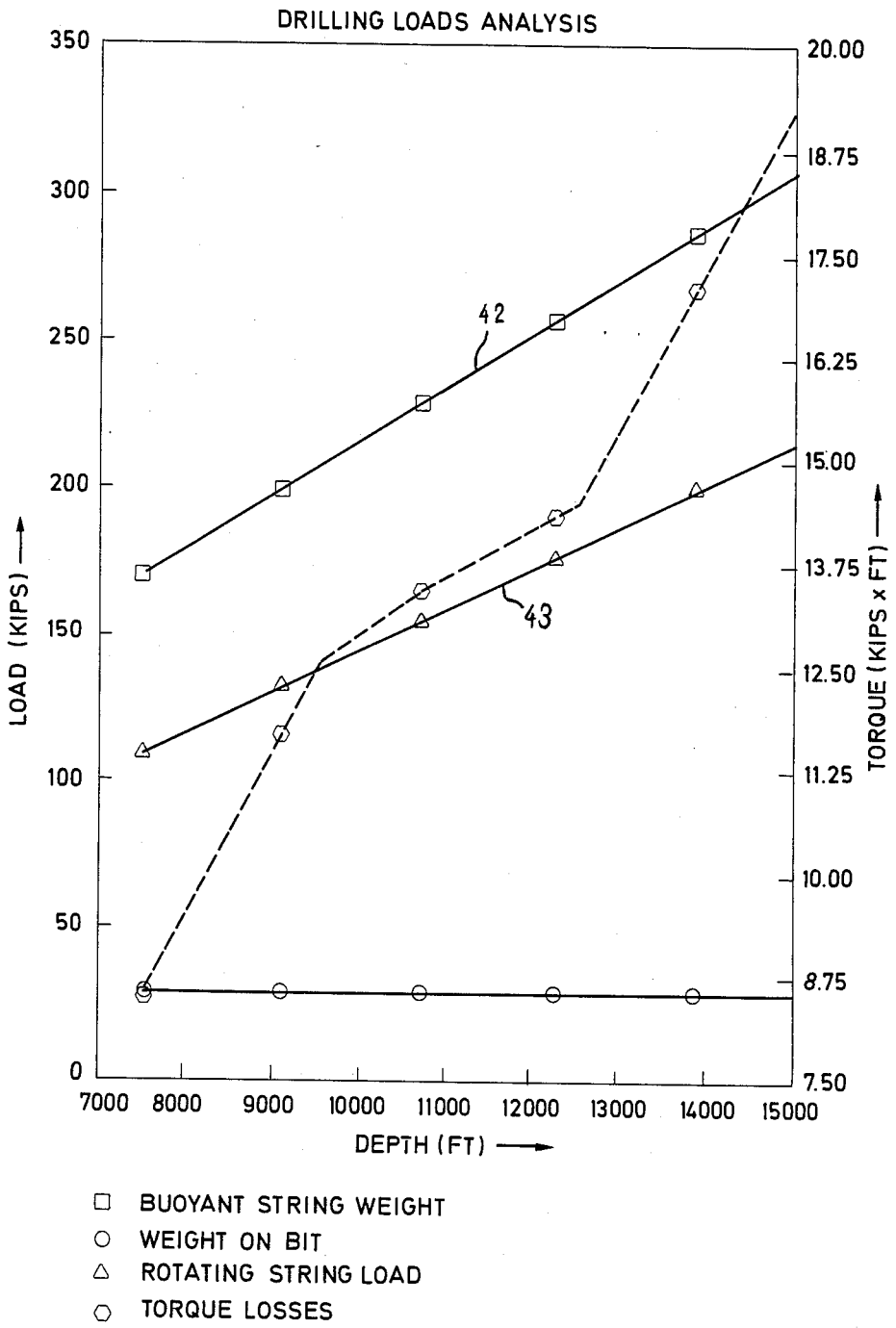
FIG. 9 shows a graphical representation of calculations of various load parameters in accordance with the present invention.

FIG. 9 shows an example of a graphical representation of calculation results which is useful in well planning. In the particular example presented, trends in the torque and weight parameters are shown for the drilling ahead of a well from 7,500 feet to 15,000 feet. The coefficient of friction was assumed to be a constant 0.3, while weight-on-bit was taken to be a constant 30 kilopounds. The weight transfer was assumed complete, so that the surface and downhole weight-on-bit are the same. The buoyant drill string weight, i.e., the weight of the drill string immersed in mud, was calculated and is indicated by curve 42. The rotating string load, indicated by curve 43, is the drill string tension under the hook while rotating. This quantity includes the effect of inclination of sections of the well. The increase in buoyant weight and rotating string load is linear due to the addition of a single type of drill pipe while drilling this portion of the well. The torque losses represent the difference between the surface and the downhole torque. The shape of the torque loss curve 44 is due to different grades of drill pipe used within the string. For example, the section of lower increase in torque loss (9,500 feet to 12,500 feet) shows the effect of using 3,000 feet of aluminum drill pipe within the string. Thus, the expected loads and torque losses for a particular drill string and bottomhole assembly can be predicted, and the appropriateness of particular equipment configurations can be assessed.

What is claimed is:

1. A method for investigating conditions under which a drill string and drill bit excavate a borehole including:
   repeatedly measuring the torque applied to the drill string at the earth's surface as the drill bit passes successive depths in the borehole;
   substantially simultaneously with the above step, measuring the effective torque acting on the drill bit; and
   comparing the measured applied torque to the measured effective torque to determine the amount of torque lost as the applied torque is transferred down the drill string and recording the measurements as a function of depth.

2. The method of claim 1 further comprising the step of determining from said measurements of applied torque and effective torque a coefficient of sliding friction acting between the borehole and the drill string.

3. A method of investigating the condition of a borehole being drilled by a drill bit attached to a drill string including the steps of:
   measuring the hookload of the drill string and drill bit while drilling;
   measuring the weight on bit while drilling;
   determining from the measurements of hookload and weight on bit a coefficient of sliding friction acting between the borehole and the drill string.

4. A method for investigating conditions under which a drill string and drill bit excavate or move through a borehole including the steps of:
   a. contemporaneously deriving at both uphole and downhole locations values of a force vector placed on said drill string;
   b. deriving an indication of the path followed by said drill string in said borehole;
   c. determining an indication of tension in the drill string;
   d. in response to said indications of tension and drill string path, determining an indication of side force acting on said drill string; and
   e. in response to said indications of side force and uphole and downhole values of said force vector, determining an indication of friction factor between said drill string and the walls of said borehole.

5. The method as recited in claim 4 wherein said step of determining tension includes the steps of:
   1. deriving a measurement of weight on bit in the vicinity of the bit;
   2. determining an indication of the buoyed weight of said drill string; and
   3. in response to said measurement of weight on bit, said indication of buoyed weight and said drill string path, determining the tension of the drill string.

6. The method as recited in claim 4 wherein steps a. through e. are repeated at each of a plurality of positions as the depth of the drill string in the well is varied to obtain a depth varying indication of friction factor.

7. The method as recited in claim 6 wherein said steps a. through e. are repeated over a cased section of said borehole in order to correct the depth varying indication of friction factor for the effects of casing.

8. The method as recited in claim 6 wherein said depth varying indication of friction factor is monitored to reveal actual or potential problems with the process of drilling the well.

9. The method as recited in claim 4 wherein said surface derived force vector includes hookload and said downhole derived force vector includes weight on bit and wherein said friction factor includes sliding friction factor.

10. The method as recited in claim 4 wherein said surface derived force vector includes surface torque and said downhole derived force vector includes downhole torque and wherein said friction factor includes rotating friction factor.

11. The method as recited in claim 4 further including the step of calculating hookload expected in tripping out of the borehole in response to said indication of friction factor to identify potential overpull events.

12. The method as recited in claim 4 further including the step of determining the configuration of the bottom hole assembly and in response to said configuration and to said friction factor, predicting overpull or sticking as a function of drill string position.

13. The method as recited in claim 4 wherein said force vector is torque, said friction factor is rotating friction factor and said method further includes the steps of performing the method of claim 6 after a well cleaning operation and comparing before and after indications of friction factor to evaluate the effectiveness of the cleaning operation.

14. The method as recited in claim 4 further including the step of evaluating a proposed well plan in response to said indication of friction factor.

15. The method as recited in claim 14 wherein the step of evaluating a proposed well plan includes the following steps:
   a. designing a proposed well geometry;
   b. designing a proposed drilling plan including determining a proposed botom hole assembly configuation; and
   c. calculating indications of torque transfer and weight on bit transfer in response to said friction factor indication, said proposed well geometry and said bottom hole assembly configuration.

* * * * *